US006460727B1

(12) United States Patent
Irwin

(10) Patent No.: US 6,460,727 B1
(45) Date of Patent: Oct. 8, 2002

(54) POP-UP SHEET PRODUCT DISPENSING SYSTEM

(76) Inventor: Aram J. Irwin, 4924 NE. Mallory Ave., Portland, OR (US) 97211

( * ) Notice: Subject to any disclaimer, the term of this patent is extended or adjusted under 35 U.S.C. 154(b) by 90 days.

(21) Appl. No.: 09/737,608

(22) Filed: Dec. 13, 2000

Related U.S. Application Data

(60) Provisional application No. 60/170,303, filed on Dec. 13, 1999.

(51) Int. Cl.[7] ..... B65H 1/00

(52) U.S. Cl. ..... 221/63; 206/449

(58) Field of Search ..... 221/35, 45, 48, 221/63, 303; 206/449, 812, 494; 225/106

(56) References Cited

U.S. PATENT DOCUMENTS

| | | | | |
|---|---|---|---|---|
| 459,516 | A | 9/1891 | Wheeler | |
| 2,323,395 | A | 7/1943 | Harwood | 206/57 |
| 4,534,491 | A | 8/1985 | Norton | 221/63 |
| 4,627,117 | A | 12/1986 | Morishita | 4/247 |
| 4,919,350 | A | 4/1990 | Miller | 242/55.2 |
| 5,041,317 | A | 8/1991 | Greyvenstein | 428/35.5 |
| 5,135,179 | A | 8/1992 | Morano | 242/55.54 |
| 5,205,454 | A | 4/1993 | Schultz et al. | 225/1 |
| 5,332,118 | A | 7/1994 | Muckenfuhs | 221/48 |
| 5,630,526 | A | 5/1997 | Moody | 221/45 |
| 5,704,566 | A | 1/1998 | Schultz et al. | 242/595 |
| 5,891,008 | A | 4/1999 | Bavely et al. | 493/405 |
| 6,029,921 | A | 2/2000 | Johnson | 242/160.1 |
| 6,145,771 | A | 11/2000 | Santa Cruz et al. | 242/423.1 |

*Primary Examiner*—Kenneth W. Noland

(57) ABSTRACT

An improved pop-up system for dispensing sheet products from continuous perforated web material. A perforated web (12) is drawn through a slit-like dispensing opening (14) which, though close-fitting, does not constrict the web (12). Catch flaps (18) capable of swinging out of plane with the web are formed in the web by two symmetrical cuts (20) in the same line extending perpendicularly inward from the longitudinal edges of the web; the cuts each extend through one-third of the web (12) and are bridged by a perforated region (16). When the pop-up presentment (24) is pulled, the catch flaps are drawn to the opening (14) where they catch, bend backward, and jam, becoming caught flaps (22). This causes enough tension in the perforated region (34) drawn outside the opening (14) to break the dispensed individual sheet (10) free, leaving another pop-up presentment (24). A number of different, more developed dispensers for rolls and folded stacks using this system are further detailed in additional embodiments.

20 Claims, 6 Drawing Sheets

POP-UP SHEET PRODUCT DISPENSING SYSTEM

CROSS-REFERENCE TO RELATED APPLICATIONS

This application is entitled to the benefit of Provisional Patent Application Ser. No. 60/170,303, filed Dec. 13, 1999, which is incorporated here by reference.

This application hereby incorporates by reference, in its entirety and for all purposes, my U.S. patent application Ser. No. 09/737,609, filed Dec. 13, 2000 titled "Combined Fluid and Pop-Up Sheet Product Dispensing System," naming Aram J. Irwin as inventor.

BACKGROUND

1. Field of Invention

This invention is directed toward dispensing systems for sheet products, more specifically to an improved system for pop-up dispensing of perforated sheet material.

The invention is also directed toward a method for dispensing individual sheets from a web of perforated material.

2. Description of Prior Art

Disposable sheet products, from paper towels to toilet paper to baby wipes, have become nearly ubiquitous in present day society, and both durable and disposable dispensers for such sheet products are well known and numerous in the prior art.

Developments in dispensing sheet products have focused on two primary goals which typically run counter to one another: (1) reducing cost; and (2) increasing user convenience.

Sheet products sold in continuous-web formats are typically the least costly and thus would initially seem to be the most desirable. Since most disposable sheet products are formed as a continuous web, fed in their processing from roll to roll, they require the least further processing and are least expensive when sold as a continuous web on a roll (though accordion folding the web in a container is also somewhat common).

Unfortunately, such continuous web formats are relatively inconvenient for users since the users themselves must perform the work of tearing off discrete units of the material, a task which often requires two hands and a moderate level of attention, even with pre-perforated web material. Many users are already engaged in other activities, such as holding a bottle of spray cleaner or changing a Ms baby, and not only don't have a free hand, but don't have the opportunity to pay much attention.

To address these issues of convenience, relatively inexpensive "pop-up" dispensers have been developed to dispense pre-perforated continuous web material. In such systems, the user need only grasp and pull the portion of an individual sheet protruding from an aperture in the dispenser to dispense that single sheet, such action leaving a portion of the next sheet held in the aperture and similarly presented for the next use.

Unfortunately, these pop-up systems for perforated continuous webs have proven to be inconvenient and unreliable. They require a relatively high dispensing force, since they rely on the aperture to continuously constrict, frictionally engage and grasp the sheet material with sufficient force to cause the perforated region to separate once it emerges from the container. Such higher force requirements are not only added work and inconvenience for the consumer, but they also often necessitate the use of both hands (one to pull the sheet and one to restrain the package) negating the convenience of the pop-up feature. Additionally, because the sheet is so tightly gripped by the opening, and because apertures are typically shaped such that they compress and distort the sheet as it passes through, dispensed sheets end up wrinkled or crumpled, which is not only aesthetically undesirable, but also limits the usability of the sheet when the user might have preferred or required a flat sheet. Furthermore, because there is no definite discrete point at which sheet separation occurs, separation tends to be haphazard. Frequently, sheet separation occurs early, late, or not at all, leaving the consumer with too little of the next sheet protruding to conveniently grasp, too much of the next sheet hanging out of the dispenser, or too many sheets dispensed. Finally, in order to work at all, such systems require careful fine-tuning of aperture and perforation design and anticipate only a certain range of average consumer interaction (i.e., how fast or slow and with what regularity a consumer will pull a sheet out). However, such fine-tuning may be disrupted by variations in either the manufacturing, shipping, or storage process, or variations in the manner in which consumers pull the sheets out (too slowly, too quickly, or at irregular speeds), thus increasing the likelihood that the various aforementioned separation failures will occur.

Since simple pop-up dispensers for continuous web material haven't worked reliably, numerous more complicated mechanisms and dispensers have been developed to dispense continuous web material, especially rolls, more conveniently. But such systems are invariably relatively complicated mechanical devices compared to the simple rolls being dispensed. Heavy casings, rollers, magnets, gears and the like drive up cost dramatically, create maintenance hassles, and ultimately create the major new inconvenience of disallowing mobility, since such heavy devices are inconvenient to carry from room to room and usually have to be fixably mounted to a surface. Additionally, such systems are rarely retrofittable to fit within existing dispensing systems or racks-usually, the consumer must throw out the old system to use the new one. Further, such systems tend to be very rough on the delicate softer grade of sheets preferred by most consumers, and many such systems only work with the tougher but rougher and less preferred commercial grades of sheet material.

Because it has not been previously possible to conveniently, reliably and inexpensively provide pop-up dispensing from a continuous web, the majority of inexpensive pop-up packaging has focused on dispensing of discreet, interleaved sheets.

Although interleaved pop-up systems typically do work better than prior continuous web systems, interleaved systems still have many drawbacks. Only a narrow range of reliable pop-up action exists between "chaining" and "fallback" failures. Chaining occurs when product separation fails as a sheet is removed and multiple sheets are accidentally withdrawn; fallback occurs when sheets separate prematurely before the dispensing opening and the next sheet accidentally falls back inside the package where it is difficult to reach and rethread through the opening. Finally, in order to fit within the narrow operating window that occurs between various failures, such interleaved pop-up systems require carefully fine-tuning and balancing the design of the dispensing opening size and/or shape, the extent of product overlap, compression during manufacture, shipping and/or storage, substrate properties, and in the case of pre-moistened sheets, product moisture loading. Further, such systems anticipate only a narrow range of average consumer interaction (i.e., how fast and with what regularity a consumer will pull a sheet out). Thus, the required level of fine-tuning to fit within the narrow operating window may be disrupted by variations in either the manufacturing, shipping, or storage of such packages, or variations in the manner in which consumers pull the sheets out, thus increasing the likelihood that chaining or fallback will occur.

Recent improvements in interleaved sheet dispensing have proposed to reduce the likelihood of failure, but to do so rely on irregular sheet shapes, which not only provide less versatile sheets to consumers, but also drive up scrap produced and manufacturing complexity, ultimately driving up cost as well.

Finally, such interleaved sheet systems never overcome their inherent cost disadvantage vs. continuous web systems. Discreet sheets which must be separated, folded, interleaved and stacked simply require more processing and invariably are fundamentally more expensive.

Therefore, the prior art has not demonstrated pop-up systems which are simultaneously as cost-effective as perforated continuous webs and as convenient as interleaved sheet pop-ups.

Thus, where convenience is the primary motivator, cost is sacrificed and we find pop-up interleaved facial sheets to be much more expensive than a very similar material in a less expensive format, rolled toilet paper. As a result, many consumers would admit to using the less expensive toilet paper as facial tissue and saving the more expensive facial tissue for guests.

Conversely, where cost is the primary motivator, convenience is sacrificed, and we find most consumer-grade paper towels and toilet paper on perforated, continuous web rolls. Such dispensing systems have numerous disadvantages: they cannot readily be operated one-handed; they often rip unevenly, zigging and zagging on and off the perforated strip; they frequently accidentally unwind much further than intended and excess product must be discarded or sloppily and labor-intensively re-rolled; they are usually dispensed without the benefit of any protective covering, thus subjecting them to getting wet and dirty; and they tend to be bulky (especially paper towels) and thus inconvenient to hold, carry, or store.

Therefore and overall, it would be desirable to provide an improved pop-up sheet dispensing system which combines the cost-effectiveness of a continuous web with the convenience and greater reliability previously only associated with pop-up interleaved sheet dispensing systems.

SUMMARY

This invention comprises perforated continuous webs in which catch flaps cut into the web material at each line of perforation mechanically engage a dispensing opening to provide an inexpensive and robust pop-up dispensing system.

Objects and Advantages

Accordingly, several objects and advantages of my invention are to provide a pop-up dispensing system which overall:

- provides simple and inexpensive dispensing from a pre-perforated, continuous web.
- is truly one-handed and requires little attention from the user.
- requires less overall force to dispense.
- provides more reliable sheet separation and fewer dispensing errors.
- dispenses substantially flat, uncrumpled sheets.
- requires less fine-tuning of design to work properly.
- works more reliably despite variations in production, shipping and/or storage.
- works more reliably despite variations in consumer interaction.
- avoids cost and complexity because it requires no moving mechanical parts during operation (other than the web itself and the person pulling on it).
- allows dispensing of softer, weaker consumer grade vs. tougher, rougher commercial grade sheet products.
- avoids scrap in the web manufacturing process. avoids complexity in the web manufacturing process.
- promotes even tearing across perforations in the web when sheets are dispensed. requires no mechanical maintenance other than product loading.
- is light and portable.
- can be retrofittable to existing dispensers and brackets.

Further objects and advantages of my invention are to provide a pop-up dispensing system which:

- is easy to refill and rethread.
- prevents accidental unwinding or unfolding of unused web material.
- protects undispensed portions of web material from getting wet, dirty or otherwise contaminated.
- eliminates bulk, thus making it more convenient to hold, carry or store product.

Further objects and advantages of my invention will become apparent from a consideration of the drawings and ensuing description.

DRAWING FIGURES

FIG. 1A. is a partial elevational view of a continuous web being drawn through a cross-section of a dispensing opening in a dispenser body.

Figure 2A:
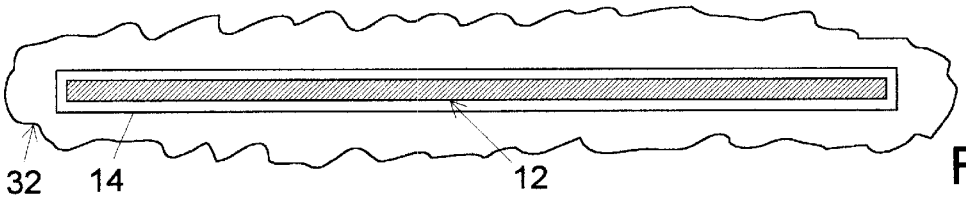
FIG. 2A is a schematic cross section from FIG. 1A of an undifferentiated portion of the web passing through the dispensing opening in the (fragmentally depicted) dispenser body. Dimensions in this figure are considerably distorted in the interest of clarity.
Figure 2B:
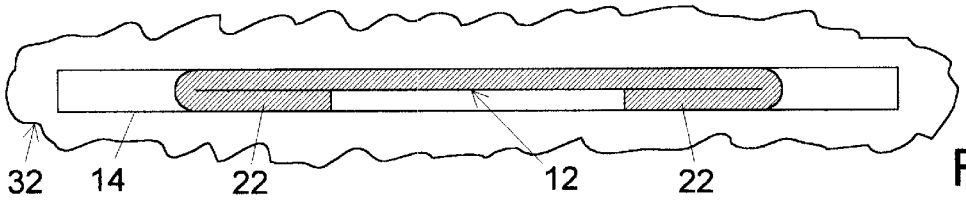
FIG. 2B is a schematic cross section from FIG. 1B of the caught flaps and web jammed in the dispensing opening in the (fragmentally depicted) dispenser body. Dimensions in this figure are considerably distorted in the interest of clarity.
Figure 2C:
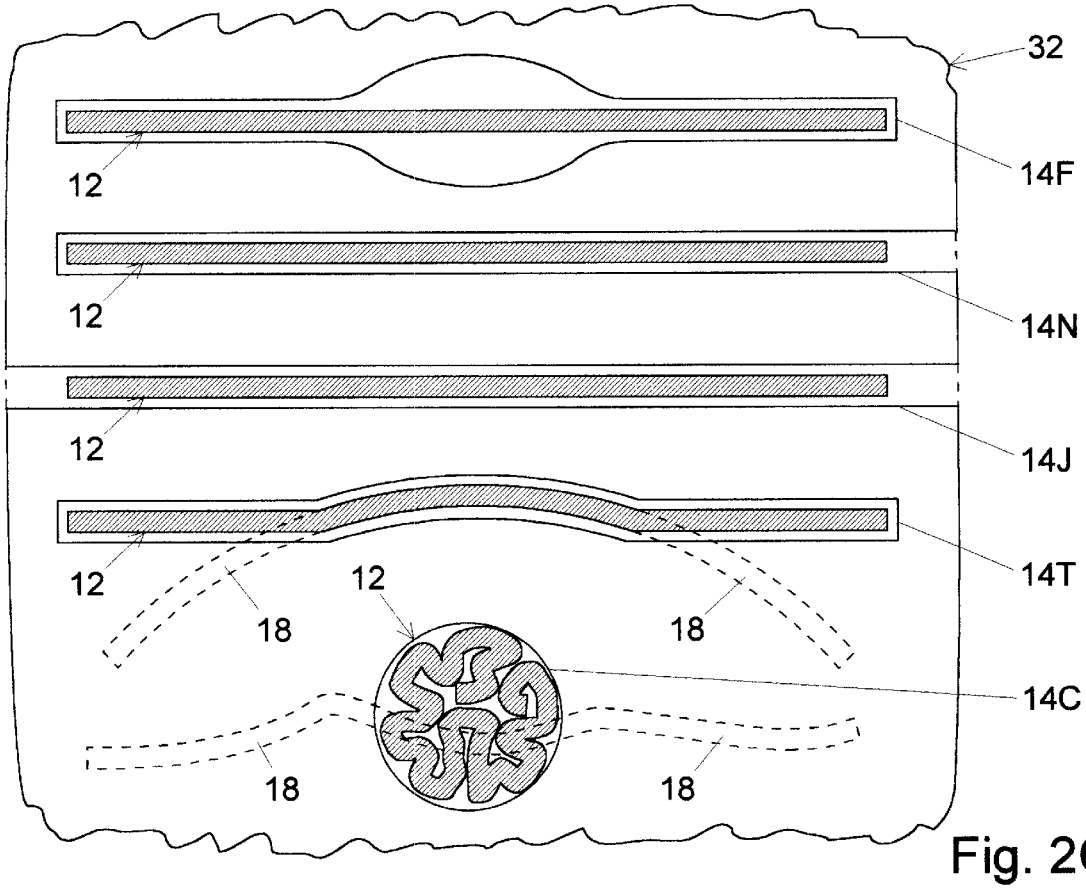

FIG. 2C is a schematic cross section, similar to 1A and 1B, of further embodiments showing more examples of dispensing opening shapes. All openings are in the same fragmentally depicted dispenser body for easy comparison. Dimensions in this figure are also distorted in the interest of clarity.

Figure 1A:
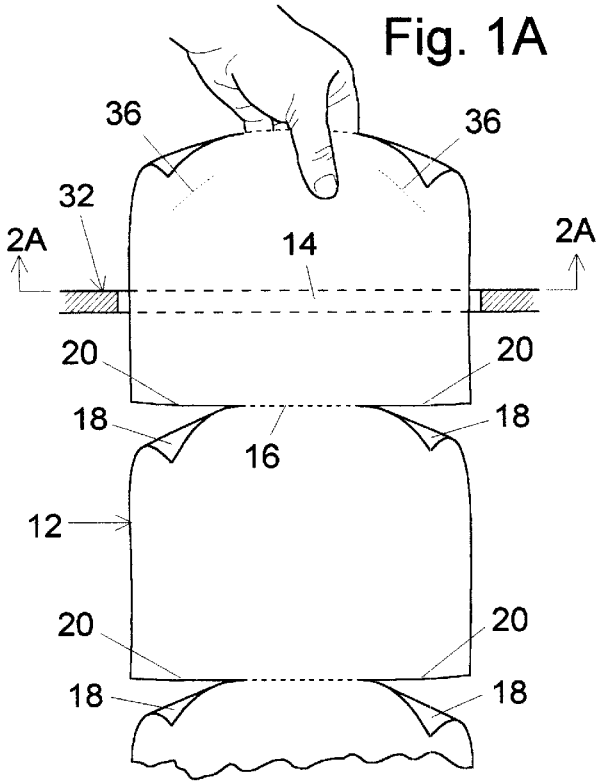
FIG. 1B is a partial elevational view of the web depicted in 1A being drawn further through and catching in the dispensing opening.
FIG. 1C is a partial elevational view of an individual sheet tearing free from the web depicted in 1A and 1B and leaving a pop-up presentment ready for the next use.
Figure 1B:
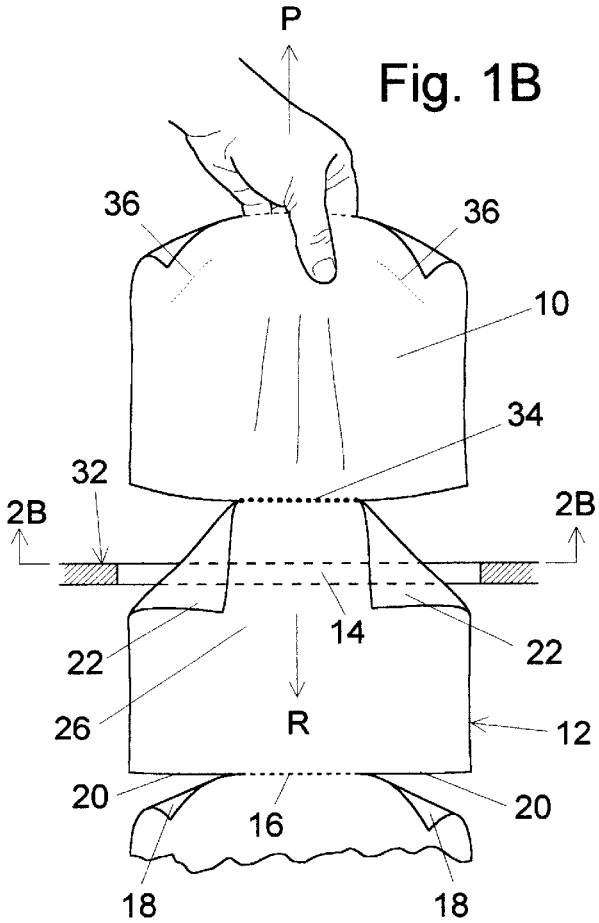
Figure 1C:
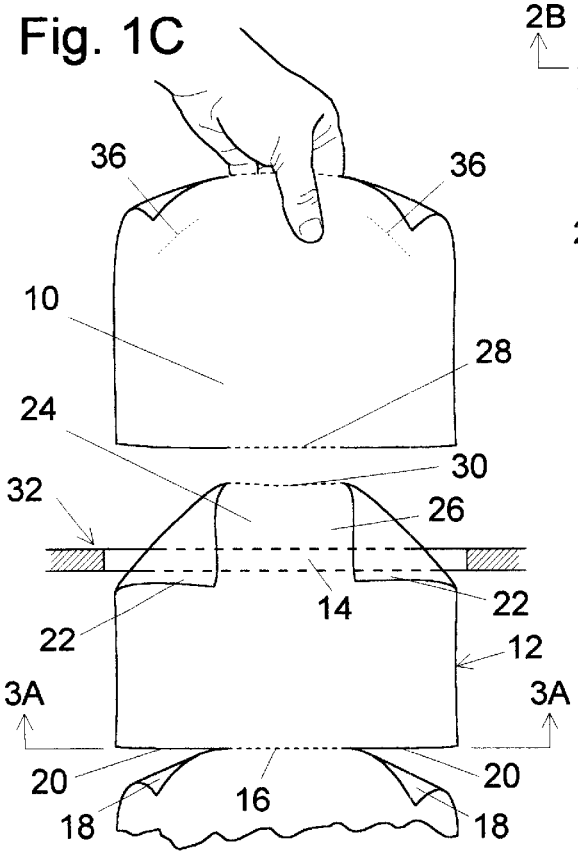
Figure 3A:
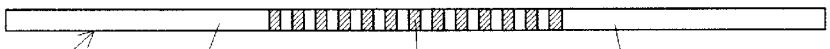

FIG. 3A is a cross-section of the web from FIG. 1C across the cut and the perforated areas.

Figure 3B:
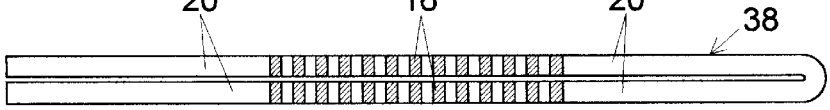

FIG. 3B is a cross-section similar to FIG. 3A showing a further embodiment of the invention in which the web is folded longitudinally.

Figure 4A:
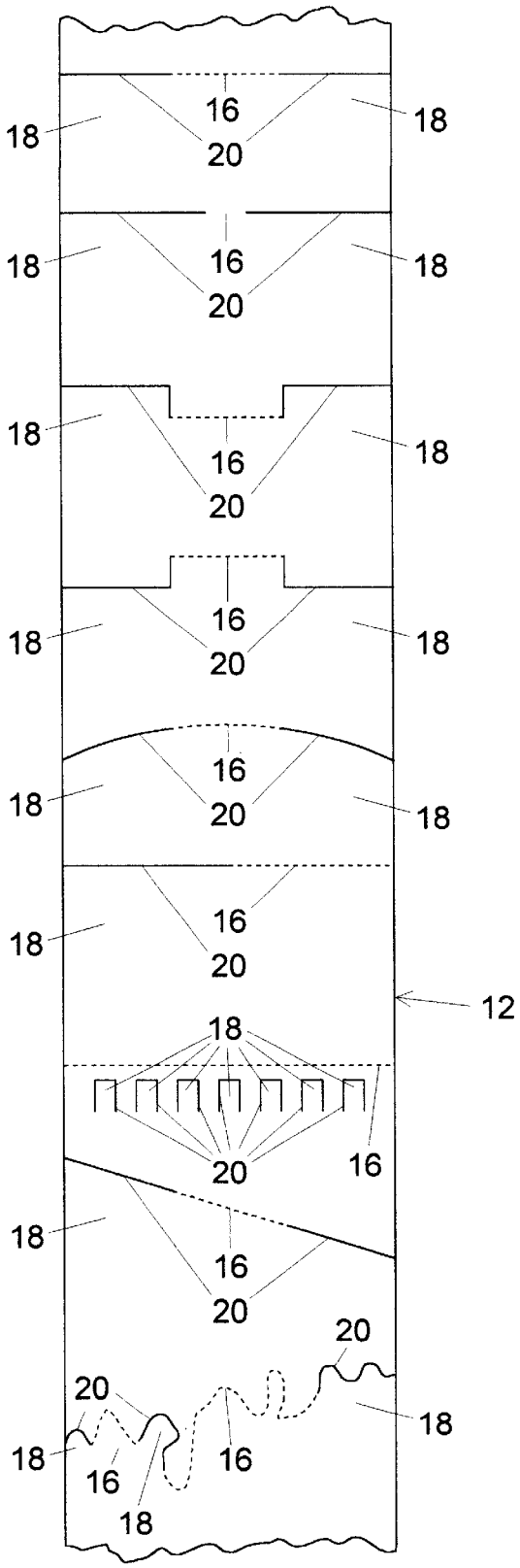

FIG. 4A is a schematic plan view of further embodiments showing more examples of combinations of cuts and perforated regions producing different kinds of catch flaps.

Figure 4B:
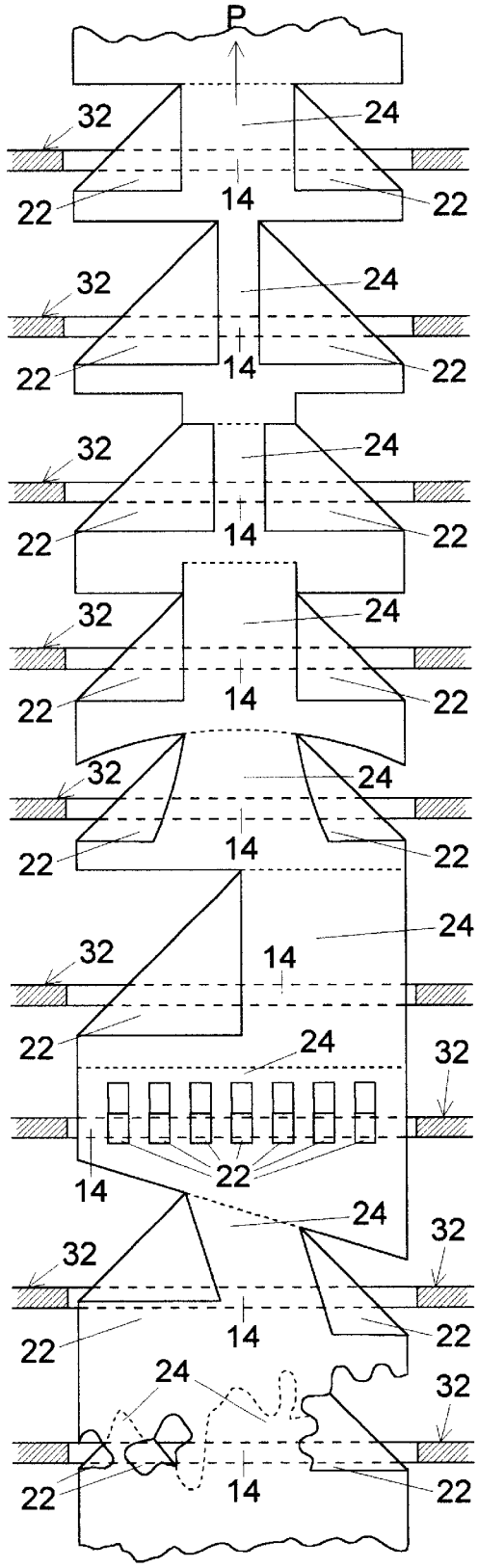

FIG. 4B is a schematic elevation of the examples of 4A being drawn through cross sections of to dispensing openings in hypothetical dispensing bodies, showing how the catch flaps become caught.

Figure 5A:
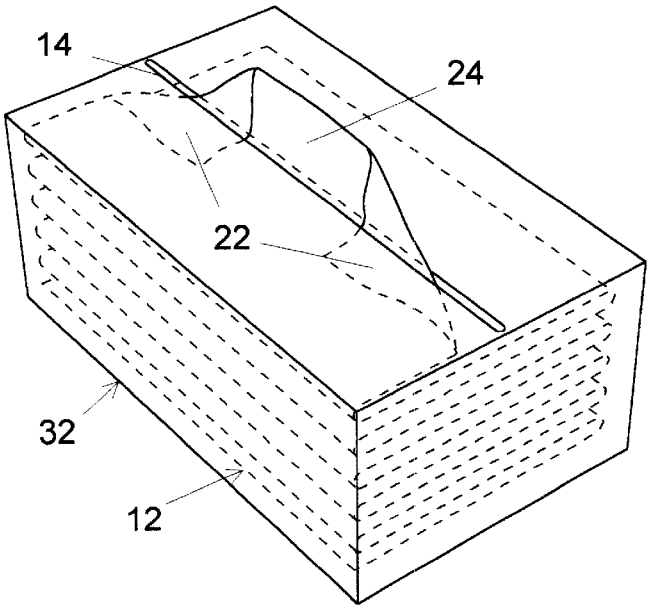

FIG. 5A is a perspective view of a further embodiment of the present invention, in which the web is accordion-folded and placed into a generic dispenser body.

Figure 5B:
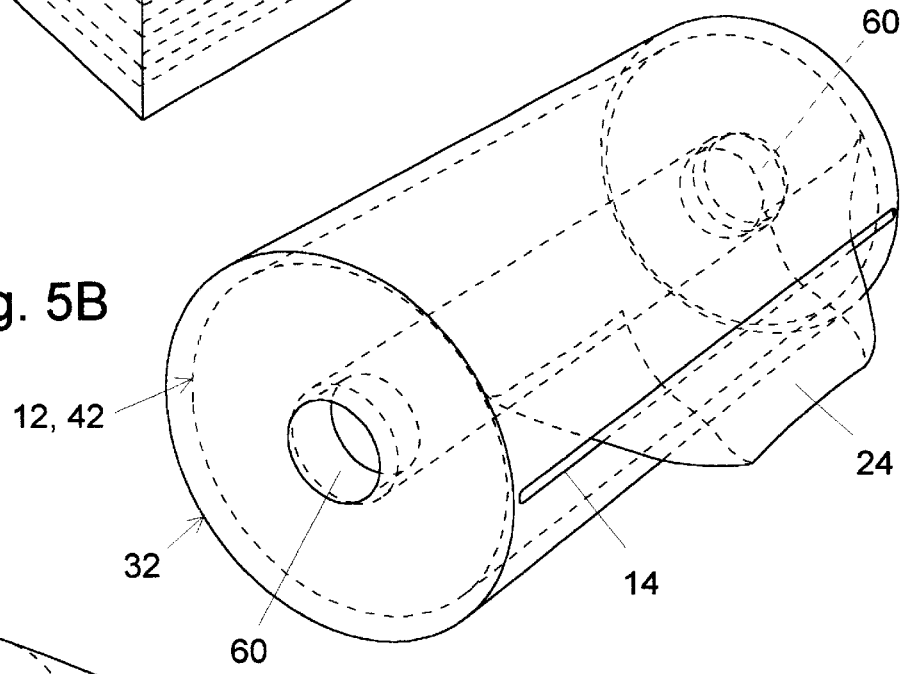

FIG. 5B is a perspective view of a further embodiment of the present invention, in which the web is rolled and placed into a generic dispenser body.

Figure 6:
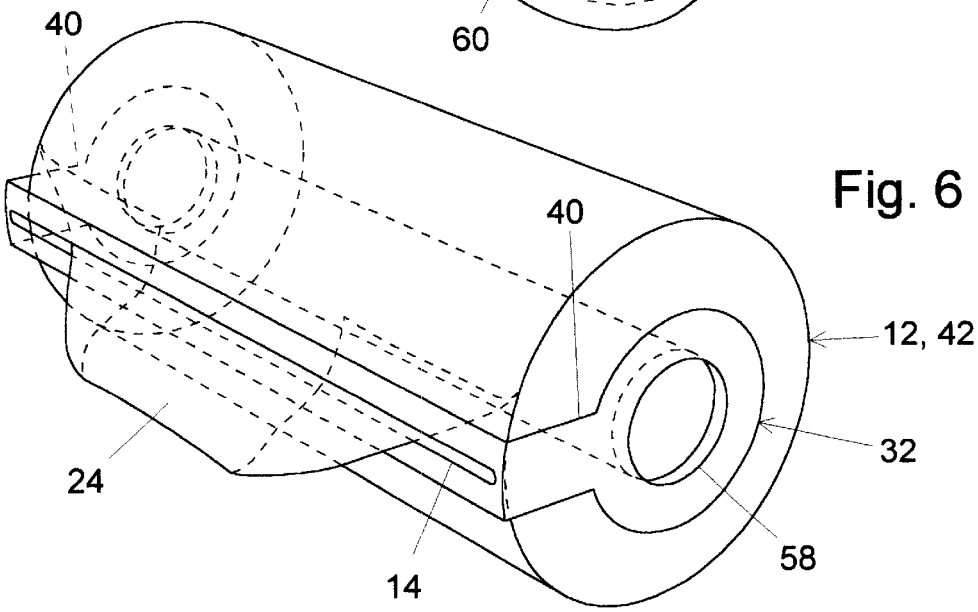

FIG. 6 is a perspective view of a further embodiment of the present invention, in which the web is rolled onto a core and placed in a bracket intended for retrofitting in a pre-existing rack.

Figure 7A:
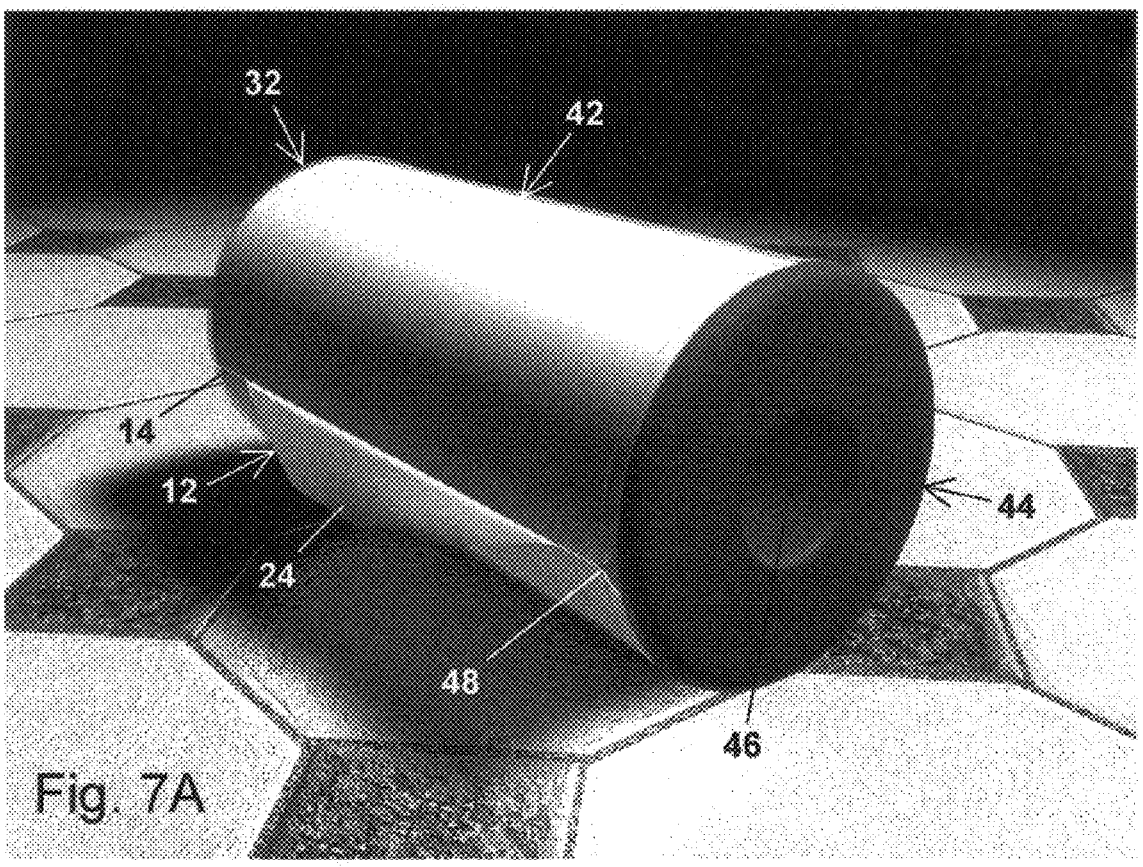

FIG. 7A is a perspective view of a large, refillable roll-dispenser, a further development of the embodiment of FIG. 5B.

Figure 7B:
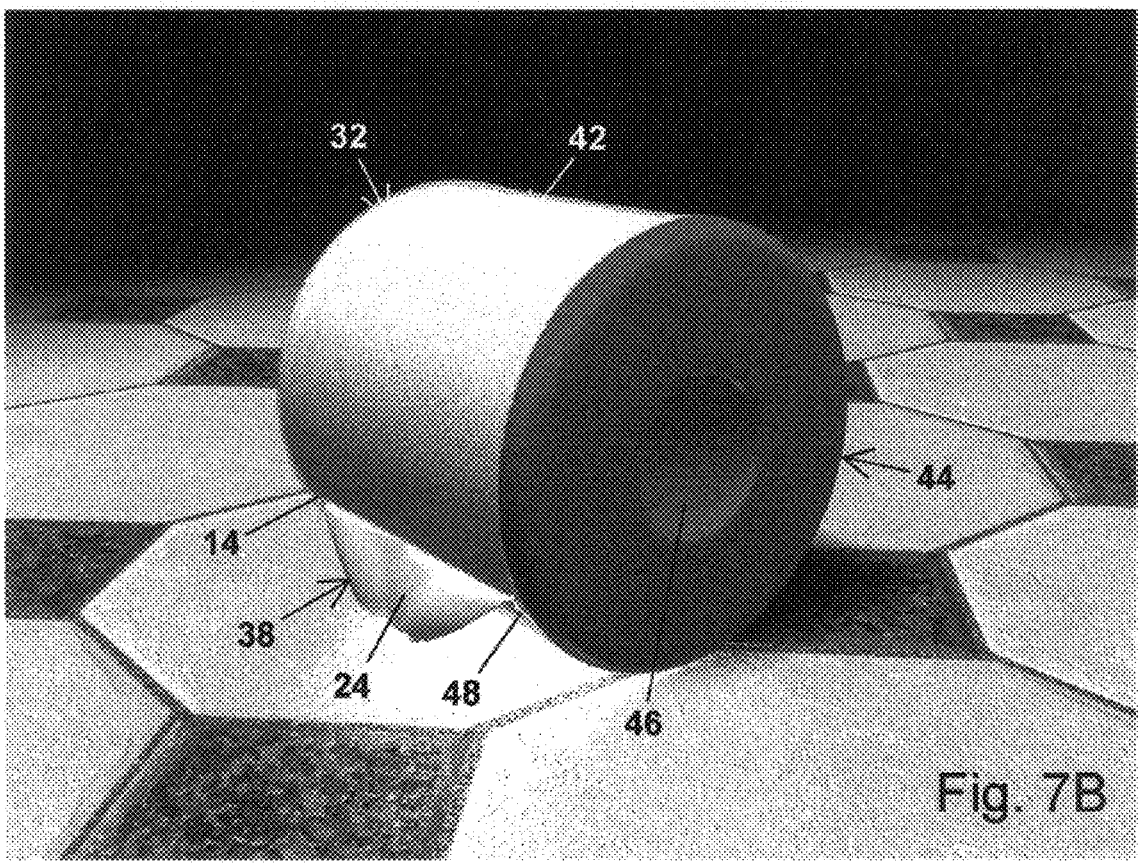

FIG. 7B is a perspective view of a "mini-roll" version of the dispenser shown in FIG. 7A.

Figure 7C:
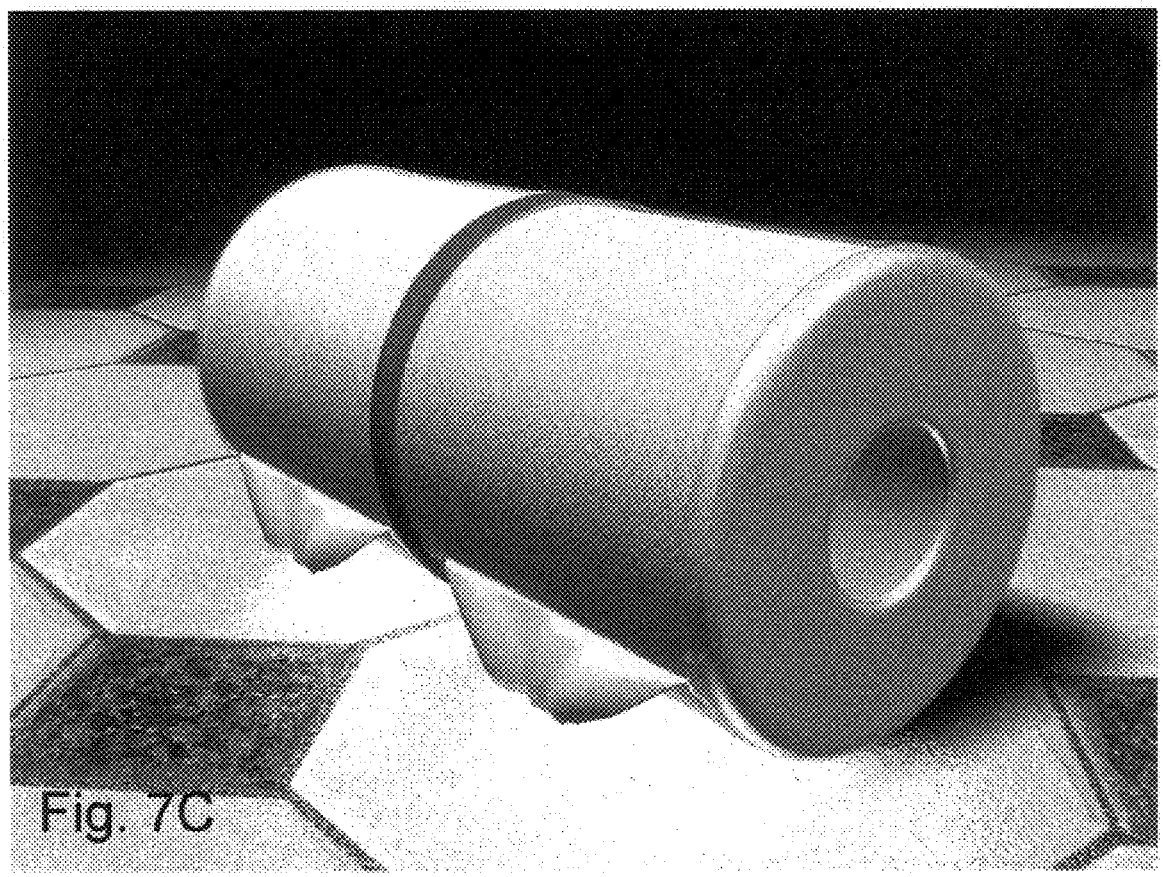

FIG. 7C is a perspective view of two mini-roll dispensers dispensing side-by side.

Figure 7D:
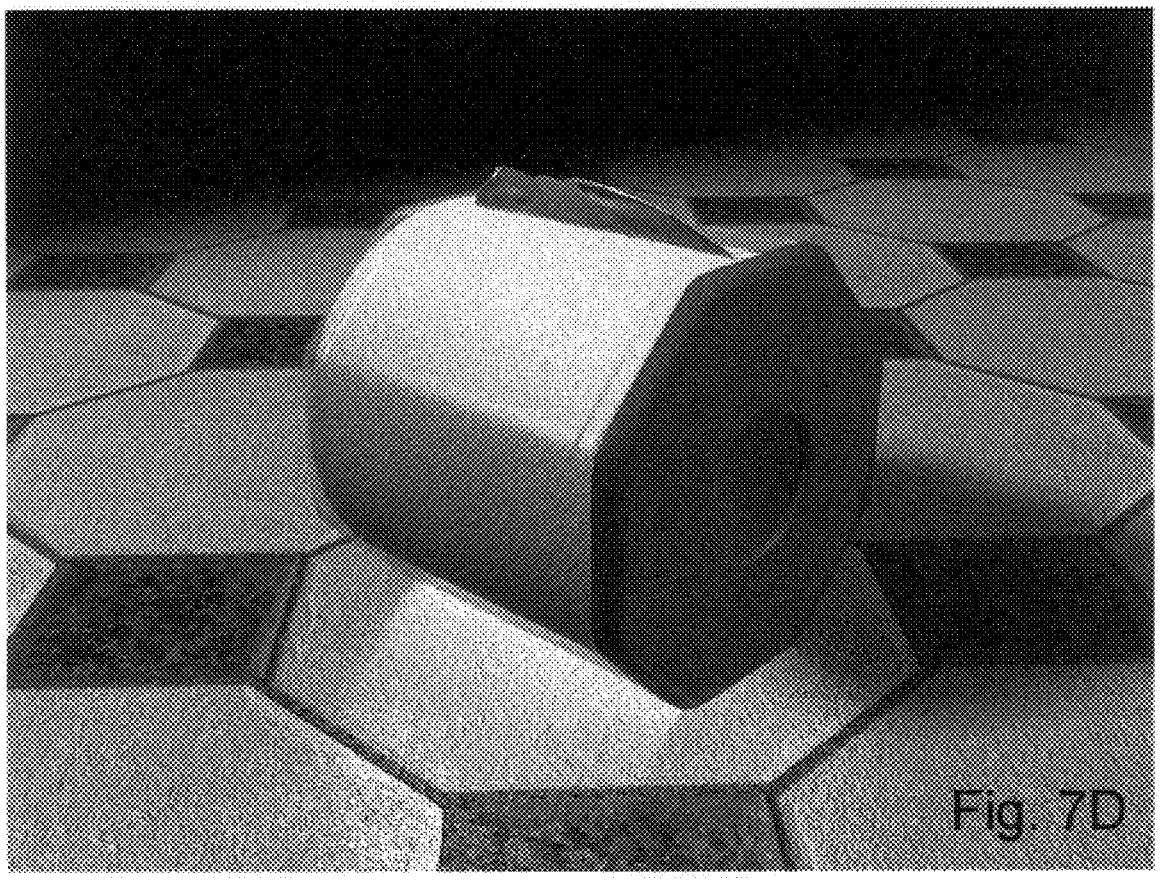

FIG. 7D is a perspective view of a stand-alone, non-rolling version of the mini-roll dispenser.

REFERENCE NUMERALS AND LETTERS IN DRAWINGS

| | |
|---|---|
| 10 | dispensed individual sheet |
| 12 | continuous web |
| 14 | dispensing opening |
| 14F | finger opening |
| 14N | notch opening |
| 14J | jaw opening |
| 14T | trainer opening |
| 14C | constricting opening |
| 16 | perforations |
| 18 | catch flaps |
| 20 | cuts |
| 22 | caught flaps |
| 24 | pop-up presentment |
| P | user's pull |
| R | resistance to pull |
| 26 | caught sheet |
| 28 | dispensed sheet trailing edge |
| 30 | caught sheet leading edge |
| 32 | dispenser body |
| 34 | outside perforations |
| 36 | creases |
| 38 | longitudinally folded web |
| 40 | bracket arms |
| 42 | roll |
| 44 | lid |
| 46 | roll-locating dimple |
| 48 | lead-in notch |
| 58 | rack hole |
| 60 | roll-locating rack hole |

DESCRIPTION—FIGS. 1A TO 2B—PREFERRED EMBODIMENT

FIG. 1A shows a continuous ribbon or web 12 of sheet material being drawn through a dispenser aperture, orifice or opening 14 in the dispenser body 32 shown here in cross-section. The thickness of the material of the dispenser body 32 has been exaggerated for clarity.

The web 12 is regularly transversed by a predetermined line of frangibility or perforations 16 at right angles to the major axis of the web 12 and at predetermined intervals; these perforations 16 define individual sheets which will be dispensed.

Rather than extending across the entire width of the web 12, the perforations 16 extend only across approximately the center third of the web 12. Wings or flaps 18 have been formed by cutting across, rather than perforating, the outer third of the web 12 on each side. Cuts 20 extend outwardly from the edge of the line of perforations 16 along the same line as the line of perforations 16. These cuts then form the flaps 18. They are referred to here as flaps because they are capable of swinging out from the overall ribbon of the web 12 and tend to do so unless otherwise constrained, especially when the web 12 bends, twists, is in motion, or is under tension or compression along its major axis.

FIG. 2A shows a cross section from FIG. 1A of an undifferentiated portion of the web 12 passing through the dispensing opening 14 in a fragment of the dispenser body 32. The opening 14 is approximately twice as wide as the thickness of the sheet material of the web 12 and the opening 14 is long enough to accommodate the fill breadth of the web 12 without constricting it. As a result of being essentially unconstricted in any dimension over its undifferentiated areas, the web 12 may pass through the opening 14 uncrumpled and with almost no resistance to pull, desirable outcomes for the user.

FIG. 1B shows the web 12 being drawn further out. When the flaps 18 are drawn to the dispensing opening 14 by the user's pull P, they mechanically engage and catch the edge of the opening 14 and instead of going through, they bend backwards and jam either behind or in the opening 14, forming caught flaps 22.

FIG. 2B shows a cross section from FIG. 1B of the caught flaps 22 jamming themselves and the rest of the web 12 in the dispensing opening 14.

At this point, referring back to FIG. 1B, the caught flaps' 22 mechanical and frictional engagement with the dispensing opening 14 and dispenser body 32 creates a resistance R in opposition to the user's pull P sufficient to create a tension in the portion of the web 12 protruding from the opening 14 greater than the tensile strength of the perforated region 34 outside the opening 14. Note that this causes no additional tension to perforated regions 16 inside the opening 14, thus eliminating the problem of sheets accidentally breaking off inside the dispenser. At this point, the outside perforations 34 are no longer strong enough to maintain connection between the dispensed sheet 10 and the caught sheet 26

FIG. 1C shows that the trailing edge 28 of the dispensed sheet 10 then breaks free of the leading edge 30 of the caught sheet 26, leaving a reliable pop-up presentment 24 projecting beyond the opening 14, ready for the next use. Note that pulling on the symmetrical pop-up presentment will usually result in a substantially more centered pull P on the major axis of the web than the asymmetric pull most users employ in tearing sheets off a web by hand, and this centered pull in combination with the deep cuts 20 leading into the perforations 16 promotes reliably even tearing across perforations when sheets are dispensed.

Referring now to all previously mentioned FIGS. 1A to 2B, the size, shape, positioning and relative proportions of the cut regions 20 and perforated regions 16 across the web 12 control the size, shape and positioning of the pop-up presentment 24. For example, the preferred embodiment as depicted shows the cuts 20 as being symmetrical to both sides of the perforations 16. This ensures that the pop-up presentment 24 is always conveniently centered in the opening 14, regardless of any changing orientation of the user or the pull P. If for some reason a presentment to only one side was desired, a single cut could extend across one half of the web and the perforated region across the other. Note however that having two flaps 18 rather than one creates an additional level of functional robustness, providing built-in redundancy should one of the caught flaps 22 fail to sufficiently engage the opening 14.

The relative proportion of cut regions 20 to perforated regions 16 across the web 12 also affords considerable control over several other key variables. An increased proportion of length of cut regions 20 to overall length of perforated regions 16 results in greater resistance R caused by the larger and wider resulting catch flaps 18 and a decreased overall tensile strength of the perforated region 16 caused by its correspondingly reduced overall length; the resulting greater resistance R will require a greater initial pull P to pull the caught flaps 22 through the opening 14, but a lesser final pull P to separate the weakened perforated section 16.

Note in FIG. 2B that many variables will affect the specific design of dispensing opening dimensions, previously only generally described. A relatively flexible dispenser body 32 and opening 14, or a relatively compressible sheet material will tend to allow the web 12 and caught flaps 22 to slip through the opening 14 more easily, so it may be necessary to make the opening 14 less than twice as wide as the thickness of the web 12 to ensure that the caught flaps 22 catch in the opening 14. Conversely, a relatively stiff or less compressible material in a relatively rigid body 32 or inflexible opening 14 may require a wider opening.

OPERATION—FIGS. 1A TO 2B—PREFERRED EMBODIMENT

The manner of using the pop-up dispensing system is essentially identical to that for most truly one-handed pop-up systems in present use, though this system functions robustly across a wide range of pull angles and speeds, which is not necessarily typical of most systems in present use.

First one grasps the pop-up presentment 24 with one hand, the presentment 24 shown here ready for grasping in FIG. 1C. Then one pulls the presentment 24 generally away from the dispensing opening 14, though exact speed or angle of pull is relatively unimportant. A moderate amount of force is required here to pop the caught flaps 22 out of the opening 14, though not so much that a second hand to restrain the dispenser would be required.

As shown in FIG. 1A, after the caught flaps 22 have popped through the opening 14, they typically spring back outward, sometimes leaving visible slight creases 36 at the point of folding, though in some materials these creases 36 are essentially indiscernible. Prior to the next catch flaps 18 being caught, one may draw the web 12 through the opening 14 with almost no resistance.

Then, as shown in FIG 1B, the next set of catch flaps 18 become caught in the opening 14. The user may now exert a force less than the initial force of pulling to cause sufficient tension in the external perforations 34 to break free an individual sheet 10, as shown in FIG. 1C. This leaves the next pop-up presentment 24 firmly grasped in the dispensing opening 14 available for the next use.

DESCRIPTION AND OPERATION—FIGS. 2C TO 3B—FURTHER EMBODIMENTS

FIG. 2C is a schematic cross section, similar to FIGS. 1A and 1B, of further embodiments showing more examples of dispensing opening shapes. All openings are in the same fragmentally depicted dispenser body 32 for easy comparison. All openings are threaded with an undifferentiated portion of the web 12 of the preferred embodiment, which means that, following the undifferentiated portion, it is perforated in the center third and cut to form catch flaps 18 across the outer third, as previously described. Dimensions in this figure are exaggerated for clarity. The various openings are:

A finger opening 14F allows users to reach in to thread the first sheet. Note that while it is important to maintain a consistent slit-like opening over the outer thirds of the web 12 opposite the catch flap areas, no particular opening shape is required over the center third perforated area.

A notch opening 14N helps users thread sheets by sliding in edge-wise, rather than straight through. Note that the system does not require constraint in the direction of the web's minor axis.

A jaw opening 14J further takes advantage of the systems ability to function without constraint in the direction of the web's minor axis. Such a jaw opening 14J allows for dispensing through a gap and greater flexibility in system design.

A training opening 14T trains the web to curl in one direction; by curling the center third of the web down through all the perforated sections, the entire rest of the web also curls, except the very first sheet, where the it is bent backwards over the other third by the outer third of the training opening 14T. This means that the subsequent sheet's catch flaps 18 will definitely be out of alignment with the first sheet and the outer third of the training opening opposite the catch flaps. Thus, the likelihood that the catch flaps 18 will get caught increases to near-certainty.

A continuously constricting opening 14C runs counter to all other embodiments herein. All other embodiments seek to minimize or eliminate constriction while undifferentiated portions of the web pass no through, thus ensuring an easy pull and an unwrinkled sheet. However, the catch flaps do work with constricting openings, so even though this is not a preferred embodiment by any means, it is demonstrated here nonetheless. In the small round constricting opening 14C seen here, the entire breadth of the web 12 of the first sheet is jammed in the opening 14C. The following second sheet, attached in the center third to the first sheet, is remarkably unperturbed by the severe constriction of the first sheet. Its catch flaps 18 remain spread wide and will certainly catch, fold backward and jam in the opening 14C when pulled through, thus still providing a pop-up function.

The embodiments of 4A and 4B are provided to demonstrate the flexibility of the system; many other configurations will work so long as they in some measure catch the catch flaps, bending them backwards and jamming them along with the web in the opening with sufficient force to overcome the strength of the perforated section of the web drawn outside the opening.

DESCRIPTION AND OPERATION—FIGS. 3A TO 3B—FURTHER EMBODIMENTS

FIG. 3A is a cross-section from FIG. 1C of the web 12, depicting the cut areas 20 and the perforated area 16. FIG. 3A is represented primarily for comparison to FIG. 3B.

FIG. 3B shows a further embodiment of the invention, namely, a longitudinally folded web 38. By treating this folded web 38 essentially as if it were a doubly thick version of the unfolded web 12 described in FIGS. 1A through 3A above, the same basic cut regions 20 and perforated regions 16 will result and the same pop-up action will be achieved with the folded web 38 as with the unfolded web 12. This folded web 38 may be used rather than the unfolded web 12 in any embodiment of this invention described here above or below, provided the dispensing opening 14 is proportionally widened to accommodate the additional material thickness.

Operation of this embodiment of the invention is identical to the first named embodiment described in FIGS. 1A to 3A above. The primary difference is that with the folded web 38 more material is dispensed in one pull than from an unfolded web 12, thus making it possible to design smaller dispensers.

DESCRIPTION AND OPERATION—FIGS. 4A TO 4B—FURTHER EMBODIMENTS

FIG. 4A is a schematic plan view of further embodiments showing more examples of combinations of cuts 20 and perforated regions 16 producing different kinds of catch flaps 18.

FIG. 4B is a schematic elevation of the examples of 4A being drawn upwards through cross sections of dispensing openings 14 in hypothetical dispensing bodies 32, showing how the catch flaps 18 of FIG. 4A have become caught flaps 22.

The embodiments of 4A and 4B are provided to demonstrate the flexibility of the system; many of them would provide less desirable operation than the preferred embodiment. But they demonstrate the key constraints to designing catch flaps 18: that there be at least one per individual sheet and that they are capable of swinging out of the plane of the web 12 to bend backwards as they are drawn to the opening 14. The catch flap(s) 18 on each individual sheet aid in the dispensing not of the sheet they are on, but in the dispensing of the sheet that precedes them through the opening 14.

Note that the topmost embodiment illustrated in FIGS. 4A and 4B is the preferred embodiment of 1A to 2B, and is not intended to be reintroduced as a new embodiment, but is here merely for comparison's sake.

Operation of these embodiments are identical to the preferred embodiment of FIGS. 1A to 2B.

DESCRIPTION AND OPERATION—FIGS. 5A TO 5B—FURTHER EMBODIMENT

FIG. 5A shows a simplified view of a further embodiment of the present invention, depicting the web 12 of FIGS. 1A to 2B now accordion folded into a generic dispenser body 32. As noted above, the web 38 shown in FIG. 3B could be substituted.

FIG. 5B shows a simplified view of a further embodiment of the present invention, depicting the web 12 (or 38) rolled onto a core and stored in a generic dispenser body 32 intended for either portable or retro-fittable use in any common existing rack for refillably dispensing common sheet materials (such as paper towels or toilet paper) from a continuous web on a roll. For portable use, the dispenser has at both ends of its major axis roll-locating rack holes 60 which have an outer diameter slightly smaller than the inner diameter of the roll core, whereby the roll 42 may spin on the roll-locating rack holes 60. For retro-fittable use, the holes in the roll-locating rack hole should accommodate most pre-existing racks. Or, depending on the rack to which it is retrofit, the dispenser body 32 could have different mating details such as dimples or simple holes at either end of the major axis instead of the roll-locating rack holes 60.

The dispenser body 32 could be a durable dispenser or a re-usable or non-reusable package or wrapping; it could be rigid or flexible and of any suitable material. It could have a separate or hingably attached lid, or could hingably split entirely open like a clamshell. Operation of this embodiment is identical to the first named embodiment described in FIGS. 1A to 2B above.

DESCRIPTION AND OPERATION—FIG. 6—FURTHER EMBODIMENT

FIG. 6 shows a further embodiment of the present invention, wherein the web 12 is rolled onto a core and the dispenser body 32 is a bracket intended for retrofittably fitting into a pre-existing rack. The bracket has two arms 40 provided with rack holes 58 approximately the same diameter as the inner diameter of the roll core, through which whatever means the pre-existing rack uses to hold rolls can pass. The arms 40 are approximately as long as the radius of the roll 42 and are approximately as far apart as the length of the roll 42. The bracket is preferably made of cardboard or the like, though it could be of plastic and formed by other means such as injection molding or vacuum forming.

Operation of this embodiments of the invention is identical to the first named embodiment described in FIGS. 1A to 1C above, with the additional steps of, prior to use, positioning the bracket around the roll 42 such that the rack holes 58 are in alignment with the roll core and then placing both bracket and roll 42 in the pre-existing rack.

DESCRIPTION AND OPERATION—FIGS. 7A TO 7D—FURTHER EMBODIMENTS

FIGS. 7A through 7D show embodiments which are further developments of the embodiment shown in 5B. In these embodiment, the web 12 (or 38) has been wound around a roll core to form a roll 42 which is stored inside the dispenser body 32 with a cap or lid 44. The dispenser body 32 is retrofittable to preexisting racks, either with roll-locating dimples 46 as shown, or optionally with the rack holes 58 or roll-locating rack holes 60 of FIGS. 5B and 6 above. The dispenser body 32 has the same dispensing opening 14 of previous embodiments, with the addition of a lead-in notch 48.

FIG. 7A shows an embodiment for larger standard size paper towels using a non-folded web 12, while 7B through 7D show embodiments for use with a smaller roll using a folded web 38 to dispense full size sheets despite their small size. FIG. 7B shows a round "mini-roll" and 7C illustrates an interesting further development of this embodiment, the option of placing two or more mini-rolls together, thus allowing the dispensing of two or more different full-size sheet products in the same space previously taken up by one roll. FIG. 7D shows a compact, stand-alone dispenser. In this embodiment, the previously round cross sections of the dispenser body 32 and lid 44 have been changed so the dispenser will not roll. In all embodiments 7A through 7C, rack holes or roll-locating rack holes could be used instead of the roll-locating dimples shown 46.

Operation of these embodiments of the invention are identical to the first named embodiment described in FIGS. 1A to 1C above, with the additional initial step of optionally placing the dispenser body 32 in the pre-existing rack, which may be of either the fixed or portable variety and may be in any orientation and with these further additional steps should the user desire to refill the dispenser: (STEP 1) optionally remove the empty dispenser body 32 from the rack; (STEP 2) remove the lid 44; (STEP 3) slide the new roll 40 into the dispenser body 32 making sure to leave a starter sheet protruding from the roll 40 such that the starter sheet's advance loading edge is guided into the lead-in notch 48 and on into the dispensing opening 14; (STEP 5) replace the lid 44; (STEP 6) optionally insert the now full dispenser body 32 back into the rack such that the pop-up presentment 24 is oriented conveniently for dispensing.

DESCRIPTION AND OPERATION OF FURTHER EMBODIMENTS (NOT PICTURED)

Further embodiments of the present invention are: all combined fluid and pop-up sheet product dispensing systems described in my following U.S. patent application, which is incorporated herein by reference: Ser. No. 09/737,609, filed Dec. 13, 2000 titled "Combined Fluid and Pop-Up Sheet Product Dispensing System," naming Aram Irwin as inventor.

CONCLUSION

After reading the above descriptions of the invention as well as the ramifications to follow, the reader will see that the pop-up sheet product dispensing system of the present invention: provides simple and inexpensive dispensing from a pre-perforated, continuous web; is truly one-handed and requires little attention from the user; requires less overall force to dispense; provides more reliable sheet separation and fewer dispensing errors; dispenses substantially flat, uncumnpled sheets; requires less fine-tuning of design to work properly; works more reliably despite variations in production, shipping and/or storage; works more reliably despite variations in consumer interaction, avoids cost and complexity because it requires no moving mechanical parts during the pop-up dispensing operation (other than the web itself and the person pulling on it); handles the web lightly enough to allow dispensing of softer, weaker consumer grade vs. tougher, rougher commercial grade sheet products; avoids scrap in the web manufacturing process; avoids complexity in the web manufacturing process; and promotes even tearing across perforations in the web when sheets are dispensed Further, across its various embodiments, the present invention has demonstrated that it can: require no mechanical maintenance other than product loading; be light and portable; be retrofittable to existing racks, dispensers and brackets, and can allow dispensing of two or more different types of material in the same location; be easy to refill and rethread when used with the lead-in notch; prevent accidental unwinding or unfolding of unused web material; protect undispensed portions of web material from getting wet, dirty or otherwise contaminated; and, by using a longitudinally folded web, can allow for dispensing of wider sections of material from smaller dispensers, eliminating bulk and thus making it more convenient to hold, carry or store sheet product.

RAMIFICATIONS AND SCOPE

Although the description above contains many specificities, these should not be construed as limiting the scope of the invention, but rather as illustrations of some of the presently preferred embodiments of this invention. Many other variations are possible. For example:

The preferred embodiment as depicted utilizes the most conventional and inexpensive perforated web manufacturing standards: a substantially rectilinear web with straight perforations at right angles to the web. Of course the web could be of nearly any shape and the perforations could for example be irregularly spaced, different from one sheet to the next, extend at nearly any angle and need not be in a straight line.

The web could be pre-moistened, dry, infused with powder, etc.; it could be single or multi-ply, it could be folded or z-folded longitudinally, it could be folded more than once longitudinally, etc.

Either the cuts or the perforations could be longer or shorter, at different angles from each other, they need not be straight, etc.

Cuts need not be cuts per se; they could for example be perforated sections which were purposefully pre-torn during the manufacturing process. Any means of creating a line of frangibility, such as scoring, would be an acceptable substitute for the perforations depicted; one could also create between two cuts an area of uncut web so narrow as to itself essentially constitute a single large perforation.

The preferred embodiment's dispensing opening as depicted is a straight slot which does not constrain the web because such an opening makes it easy for the web to pass through and to do so unwrinkled. However, the dispensing opening need not be either straight or a slit. It could be zigzagged, curved, wavy etc.; or it could be an triangle, oval, circle, irregular shape, etc.—any opening which does not constrict the web but provides means for the flaps to become caught as they travel through the opening will work, and any opening which does constricts the web, sufficiently engaging the flaps, will work.

Catch flaps as depicted here are shipped flat and not folded, which takes less space and less effort; however, flaps could be pre-folded if so desired.

Rather than relying on flaps catching the dispensing opening, any means for the web and the dispensing opening to mechanically engage and catch each other would suffice, including a protruding dot of glue or embossed line on the web getting caught in the opening, a protruding tongue on the dispensing opening catching slits in the web, etc.

Thus the scope of the invention should be determined by the appended claims and their legal no equivalents, rather than by the examples given.

I claim:

1. An improved pop-up dispensing system comprising:

(a) a continuous web of sheet material divided by a plurality of lines of frangibility running at predetermined intervals substantially transversely to the major axis of the web and defining individual sheets which will be dispensed, (b) a dispensing opening through which said web is dispensed, and (c) catching means for causing said web and said dispensing opening to mechanically engage or catch one another, the degree of mechanical engagement caused by said catching means between said opening and said web being greater than the degree of engagement of said opening with undifferentiated portions of said web, said catching means engaged at predetermined intervals corresponding with each line of frangibility such that when a first sheet is drawn through said opening, the following second sheet triggers engagement of said catching means such that a predetermined portion of said second sheet is pulled out and projects through said opening before said degree of mechanical engagement, in combination with a user's pull, creates sufficient tension between said first and second sheets to break the line of frangibility between said first and second sheets, freeing said first sheet and forming a pop-up presentment from said predetermined portion of said second sheet which remains projecting through said opening, and said degree of mechanical engagement being low enough to be overcome by the user's next pull without requiring the user to restrain the dispenser with a second hand, such that said second sheet is ultimately dispensed just as the first sheet, whereby the user need only grasp and pull the portion of an individual sheet protruding from said dispensing opening to dispense said individual sheet, such action leaving a portion of the next sheet firmly held in said opening and similarly presented for the next use.

2. The system of claim 1, wherein said catching means comprise at least one catch flap per said lines of frangibility, said catch flap(s) being cut into the sheet material and capable of swinging free from the overall ribbon of said web such that said flap(s) engages said dispensing opening and does not readily pass through said opening, instead jamming in said opening.

3. The system of claim 2, wherein said catch flap(s) is formed by at least one cut region connected to at least one perforated region.

4. The system of claim 3, wherein at least one of said cut regions extends to the longitudinal edge of said web.

5. The system of claim 4, wherein two cut regions are formed, one extending inwardly from each of the two longitudinal edges of said web and connecting to either side of a single central perforated region between the two said cut regions.

6. The system of claim 5, wherein all said cut and perforated regions together form a single straight line running perpendicularly across the longitudinal axis of the web and where each of the three individual regions extend approximately one-third of the way across the minor axis or width of the web.

7. The system of claim 1, wherein said dispensing opening does not constrict undifferentiated portions of the web.

8. The system of claim 1, wherein said dispensing opening is connected to a lead-in notch, whereby said web may be easily loaded into said opening.

9. The system of claim 1 wherein said web is folded longitudinally.

10. The system of claim 1, wherein a predetermined portion of said web is gathered into a grouping of a pattern and position suitable for dispensing through said dispensing opening such that the entire said portion may be dispensed.

11. The system of claim 10, wherein said grouping is selected from the group consisting of rolls and folded stacks and wherein said grouping is fixed relative to a dispenser body provided with said dispensing opening.

12. The system of claim 11, wherein said grouping is a roll with a core and said dispenser body is a bracket.

13. The system of claim 11, wherein said dispenser body comprises:

(a) a container, and (b) access means for loading new web material into said container.

14. The system of claim 13, wherein said access means are selected from the group consisting of unattached lids, lids molded together with containers, and containers opening and closing along an in-molded hinge.

15. The system of claim 13, wherein said grouping is a roll with a core and where at least one of the group consisting of said container and said access means provides in-molded core-locators additionally allowing said roll to spin on said core-locator(s) within said container.

16. A method for providing pop up dispensing, said method comprising the steps of:

(a) providing a continuous web of sheet material divided by a plurality of lines of frangibility running at predetermined intervals substantially transversely to the major axis of the web and defining individual sheets which will be dispensed, (b) providing a dispensing opening through which said web is dispensed, and (c) providing catching means for causing said web and said dispensing opening to mechanically engage or catch one another, the degree of mechanical engagement caused by said catching means between said opening and said web being greater than the degree of engagement of said opening with undifferentiated portions of said web, said catching means engaged at predetermined intervals corresponding with each line of frangibility such that when a first sheet is drawn through said opening, the following second sheet triggers engagement of said catching means such that a predetermined portion of said second sheet is pulled out and projects through said opening before said degree of mechanical engagement, in combination with a user's pull, creates sufficient tension between said first and second sheets to break the line of frangibility between said first and second sheets, freeing said first sheet and forming a pop-up presentment from said predetermined portion of said second sheet which remains projecting through said opening, and said degree of mechanical engagement being low enough to be overcome by the user's next pull without requiring the user to restrain the dispenser with a second hand, such that said second sheet is ultimately dispensed just as the first sheet, whereby the user need only grasp and pull the portion of an individual sheet protruding from said dispensing opening to dispense said individual sheet, such action leaving a portion of the next sheet firmly held in said opening and similarly presented for the next use, and whereby the user can dispense sheets with only one hand without interruption while keeping their other hand and their concentration free to focus on more important tasks, such as cleaning.

17. The method of claim 16, wherein providing said catching means comprises the step of forming at least one catch flap per said lines of frangibility, said catch flap(s) being cut into the sheet material and capable of swinging free from the overall ribbon of said web such that said flap(s) engages said dispensing opening and does not readily pass through said opening, instead jamming in said opening.

18. The method of claim 17, wherein the step of forming said catch flap(s) further comprises the step of creating at least one cut region connected to at least one perforated region.

19. The method of claim 18, wherein the step of creating said cut regions further comprises creating at least one extends to the longitudinal edge of said web.

20. In a continuous web of sheet material suitable for use in a pop-up dispensing system, said web divided by a plurality of lines of frangibility running at predetermined intervals substantially transversely to the major axis of the web and defining individual sheets which will be dispensed, the improvement comprising catch flaps cut into the web material capable of swinging free from the plane of the web, said catch flaps located at predetermined intervals corresponding with said lines of frangibility.

* * * * *